United States Patent [19]

Bourgeois et al.

[11] 4,071,366

[45] Jan. 31, 1978

[54] POLYMERIC QUATERNARY DYE IMAGE RECEIVING LAYERS WITH OVERCOAT

[75] Inventors: Gerard J. Bourgeois, Lynn; Ronald A. Sahatjian, Bedford, both of Mass.

[73] Assignee: Polaroid Corporation, Cambridge, Mass.

[21] Appl. No.: 704,026

[22] Filed: July 9, 1976

Related U.S. Application Data

[63] Continuation-in-part of Ser. No. 507,339, Sept. 19, 1974, abandoned.

[51] Int. Cl.[2] ..... G03C 7/00; G03C 1/76; G03C 1/40; G03C 5/54

[52] U.S. Cl. ..... 96/73; 96/3; 96/29 D; 96/77; 96/84 R; 96/119 R; 428/515

[58] Field of Search ..... 96/3, 29 D, 77, 84 R, 96/119 R, 73; 428/515

[56] References Cited

U.S. PATENT DOCUMENTS

| | | | |
|---|---|---|---|
| 3,227,550 | 1/1966 | Whitmore et al. | 96/3 |
| 3,271,147 | 9/1966 | Bush | 96/3 |
| 3,647,437 | 3/1972 | Land | 96/3 |
| 3,706,557 | 12/1972 | Arond | 96/3 |
| 3,709,690 | 1/1973 | Cohen et al. | 96/3 |
| 3,756,814 | 9/1973 | Bedell | 96/3 |
| 3,770,439 | 11/1973 | Taylor | 96/3 |

*Primary Examiner*—David Klein
*Assistant Examiner*—Richard L. Schilling
*Attorney, Agent, or Firm*—John P. Morley

[57] ABSTRACT

Improved diffusion transfer photographic products and processes wherein a distinctive image-receiving sheet comprising a plurality of layers one of which comprises a polymeric material providing quaternary nitrogen groups is integrated with an integral negative-position diffusion transfer film unit.

20 Claims, 7 Drawing Figures

POLYMERIC QUATERNARY DYE IMAGE RECEIVING LAYERS WITH OVERCOAT

CROSS-REFERENCE TO RELATED PATENT APPLICATIONS

This application is a continuation-in-part of U.S. Appliation Ser. No. 507,339 filed Sept 19, 1974, and now abandoned.

BACKGROUND OF THE INVENTION

1. The Field of the Invention

This invention relates to photographic products. More precisely, the invention disclosed herein relates to photographic products especially useful in providing image patterns by way of diffusion transfer photographic processes.

2. Description of the Prior Art

Diffusion transfer photographic processes and photographic products adapted for such processes are well known to the art. Essentially, such products and processes involve a photosensitive system which is exposed to activating radiation. After exposure, the resultant image can be developed to provide a diffusion transfer image which can be transferred to an image receiving sheet. Details relating to some of the better known diffusion transfer photographic products and processes can be found in U.S. Pat. Nos. 2,983,606, 3,415,644 3,415,645; 3,415,646; 3,473,925; 3,573,042; 3,573,043; 3,573,044; 3,576,625; 3,576,626; 3,578,540; 3,579,333; 3,473,925; 3,594,164; and 3,594,165 as well as in commonly assigned U.S. Pat. Nos. 3,573,043; 3,573,044 and 3,672,890. All of the above Patents and Applications are expressly incorporated herein in their entirety by reference.

Photosensitive systems employed in the products and processes of the type described in the above-mentioned Patents and Applications comprise at least one selectively sensitized silver halide layer integrated with a dye image-providing material. Moreoften, however, such diffusion transfer photographic products and processes include a photosensitive system which can provide a multicolor diffusion transfer image and photosensitive systems of this type essentially include a blue, a green and a red sensitive silver halide layer each integrated respectively with a yellow, a magenta and a cyan dye image-providing material.

Suitable dye image-providing employed in diffusion transfer photosensitive systems are those which are either (1) initially soluble or diffusible in the processing composition but are selectively rendered non-diffusible as a function of development; or (2) initially soluble or non-diffusible in the processing composition but are selectively rendered diffusible as a function of development. Accordingly, suitable dye image-providing materials may be complete dyes or dye intermediates, e.g., color couplers and especially preferred materials are those known to the art as "dyed developers", e.g., a dye which is also a silver halide developing agent.

Examples of and details relating to initially soluble or diffusible materials and their application in color diffusion transfer, can be found in U.S. Pat. Nos. 2,647,049; 2,661,293; 2,698,244; 2,698,798; 2,802,735; 2,774,668 and 2,983,606. Examples of and details relating to diffusion transfer systems employing initially non-diffusible materials can be found in U.S. Pat. Nos. 3,443,939; 3,443,940; 3,227,550; 3,227,551; 3,227,552; 3, 227,554; 3,243,294; and 3,445,228.

Diffusion transfer photographic products of the type disclosed and claimed in U.S. Pat. Nos. 3,415,644, and 3,647,437 are distinctive in that they are adapted for use under circumstances where at least a portion of the processing of the exposed photosensitive system is conducted under conditions which would ordinarily result in further exposure or fogging of the photosensitive system. Essentially, products of the type disclosed in the above Patents comprise a photosensitive component and an image-receiving component maintained in fixed relationship prior to exposure as well as after exposure and processing. In such products, which are sometimes called "integral negative-positive photographic products", the final image is viewed through a transparent layer or support against a reflecting background.

In the particularly preferred products, exposure is made through the transparent member while a light-reflecting material which can provide a reflecting background is included in the processing composition to be distributed between the exposed photosensitive element. The preferred light-reflecting material for inclusion in the processing composition is titanium dioxide which in addition to providing a suitable reflective background also performs an opacifying function by protecting the exposed photosensitive system from fogging or further exposure if the exposed product is subjected to activating radiation after photoexposure. This protection is provided during that period extending from immediately after processing is begun and continues until at least the time that development of the photoexposure is complete and/or until that time that any subsequently exposed portions of the photosensitive system cannot be developed by the processing composition involved in development of the photoexposed material.

Especially preferred integral negative-positive photographic products are those disclosed in U.S. Pat. No. 3,647,437. Such products employ a light-absorbing material or reagent—preferably a dye—to protect the exposed photosensitive system for activating radiation after photoexposure. Essentially, the light-absorbing reagent is so positioned and/or constituted so as not to intefere with photoexposure but to absorb activating radiation during development until development of the photoexposed image is complete and/or fogging cannot occur. Additionally, the light absorbing reagent is so positioned and/or constituted that it does not obstruct viewing of the diffusion transfer image at least after the image is formed in the image-receiving sheet and, in some instances, the material does not obstruct viewing of the image during a portion of the time involved in the formation of the image in the receiving sheet.

Particularly preferred light-absorbing materials of U.S. Pat. No. 3,647,437 are indicator dyes which are highly colored at the pH of the processing composition but are "cleared", e.g., rendered substantially colorless or non light absorbing at a lower pH. Especially preferred photographic products of U.S. Pat. No. 3,647,437 are those where the light-absorbing reagent is included in the processing composition together with the light-reflecting material so that both reagent and reflecting material are distributed between the photosensitive element and the image-receiving element after photoexposure.

A known diffusion transfer photographic product particularly suitable for providing monochrome or multicolor diffusion transfer image patterns of or comprising green, cyan or blue colors is one employing phthalocyanine dye developers of the type described in U.S. Pat. No. 3,482,972 issued to Elbert M. Idelson on Dec. 9, 1969. Dye developers of the type disclosed there are those conforming to the following formula:

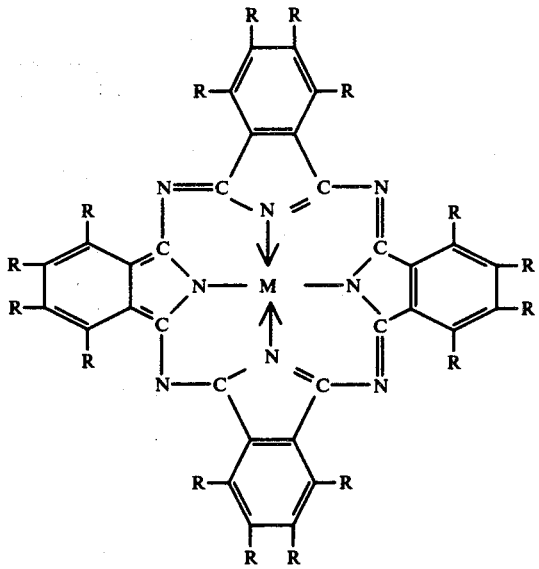

FORMULA A where that of the 16 R substituents present on the phthalocyanine ring at least one and no more than four are as $R^1$ groups, there being no more than two $R^1$ groups on any one benzene ring, the remaining R substituents being $R^2$ groups, and $R^1$ comprises a group $(—A)_n—E$; A is a divalent organic linking radical; *n* is a number of from 0 to 1; E is an aryl group selected from the group consisting of benzene and naphthalene radicals so substituted by at least two groups selected from the group consisting of hydroxyl and amino groups which are situated ortho or para to each other as to be capable of developing an exposed silver halide photographic emulsion; M is a metal selected from the group consisting of cobalt, nickel, copper, chromium, magnesium and zinc; and each $R^2$ comprises the same or a different moiety selected from the group consisting of monovalent organic and monovalent inorganic radicals, neither of which contain a silver halide developing radical, and hydrogen. Most preferred are those cyan dyes within the above formula wherein the metal moiety is copper and these dye developers may be referred to simply as copper phthalocyanine dye developers.

U.S. Pat. No. 3,770,439 issued to Lloyd D. Taylor on Nov. 6, 1973 relates to improved photographic products particularly those employing phthalocyanine dye developers of the type described above. As disclosed in U.S. Pat. No. 3,770,439, improved diffusion transfer of such phthalocyanine dyes is obtained by the use of an image-receiving sheet which comprises a polymeric material providing quaternary nitrogen groups usually in combination with other polymeric materials. Specific polymeric materials providing quaternary nitrogen groups disclosed in U.S. Pat. No. 3,770,439 include polymers comprising the following entity:

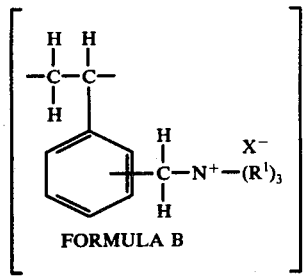

FORMULA B where each $R^1$ can be the same or different substituent chosen from the group consisting of hydrogen, hydroxyl, alkyl, alkoxy or alkanol and preferably lower alkyl, alkoxy or alkanol, e.g., wherein the hydrocarbon moiety contains 1–6 carbon atoms and $X^-$ is an anion radical.

Although improved diffusion transfer rates for phthalocyanine dye developers are obtained by the use of image receiving sheets comprising a polymeric material providing quaternary nitrogen groups, a deficiency has been noted in those photographic products comprising such receiving sheets in combination with the light-absorbing reagents of the type disclosed in U.S. Pat. No. 3,647,437. As discussed before, the function of such reagents is to provide protection for the photoexposed material from fogging and, to be "cleared", e.g., rendered substantially colorless after such protection is no longer required so that viewing of the diffusion transfer image is not obstructed. It should be understood that the time required for the reagent to provide the protective function is not necessarily equivalent to the time required for complete formation of the image in the image-receiving sheet. Actually, an especially desirable performance characteristic for such reagents is that they "clear" as soon as possible after the protective function is no longer required and in many instances, such protection need not be provided until the image is completely formed in the image-receiving sheet. Instead, "clearing" can oftentimes occur prior to complete formation of the image thereby permitting viewing of the image against a reflective background during formation thereof.

The ability of a light-absorbing reagent to clear as quickly as possible after performing its protective function is especially desirable in photographic products providing accelerated diffusion rates for dyes comprising the diffusion transfer image pattern. However, when light-absorbing reagents of the type disclosed in U. S. Pat. No. 3,647,437 are included in products employing image receiving layers comprising a polymeric material providing quaternary nitrogen groups, the rate of clearing of such reagents has been found to be undesirably slow. In other words, such photographic products provide accelerated image formation in the image-receiving sheet but the rate of clearing of the light-absorbing reagent is undesirable especially in view of the accelerated image formation. The precise cause of this slow clearing of the light-absorbing reagent is not known. However, since clearing is primarily dependent on pH, there may be some chemical or physical interaction between the reagent and the polymeric material providing the quaternary nitrogen groups which interferes with or affects the response of the reagent to pH to quickly change from a light-absorbing to a substantially colorless state.

The present invention is addressed to the above described photographic products and provides photographic products and processes wherein the rate of clearing of light-absorbing reagents is markedly improved despite the presence in image-receiving sheets of such products of polymeric materials providing quaternary nitrogen groups.

SUMMARY OF THE INVENTION

Essential elements of the improved diffusion transfer photographic products of the present invention comprise a photosensitive element preferably having a phthalocyanine dye developer as a component of the photosensitive system, a light-absorbing reagent of the type disclosed in U.S. Pat. No. 3,647,437 and an image-receiving element having an image receiving component comprising a mixture of polymeric materials at least one of which is a polymeric material providing quaternary nitrogen groups. However, the distinctive feature of the photographic products of the present invention is that the image-receiving component comprises a layer containing a polymeric material providing quaternary nitrogen groups in combination with at least one other layer which isolates the layer comprising the polymeric material providing quaternary nitrogen groups from the light-absorbing reagent. Accordingly, the image-receiving component of the products of the present invention actually comprises at least two layers of polymeric material with the polymeric material providing quaternary nitrogen groups being separated from the light-absorbing reagent by way of at least one other (or second) layer which is permeable to the image dyes. In accordance with the practice of the present invention, it has been discovered that the separation of the layer comprising the polymeric material having quaternary nitrogen groups from the light-absorbing reagent which is interposed between the photosensitive and image-receiving elements markedly improves the desired performance characteristics of the light-absorbing reagent employed in the photographic products.

DESCRIPTION OF THE PREFERRED EMBODIMENTS

Figure 1:
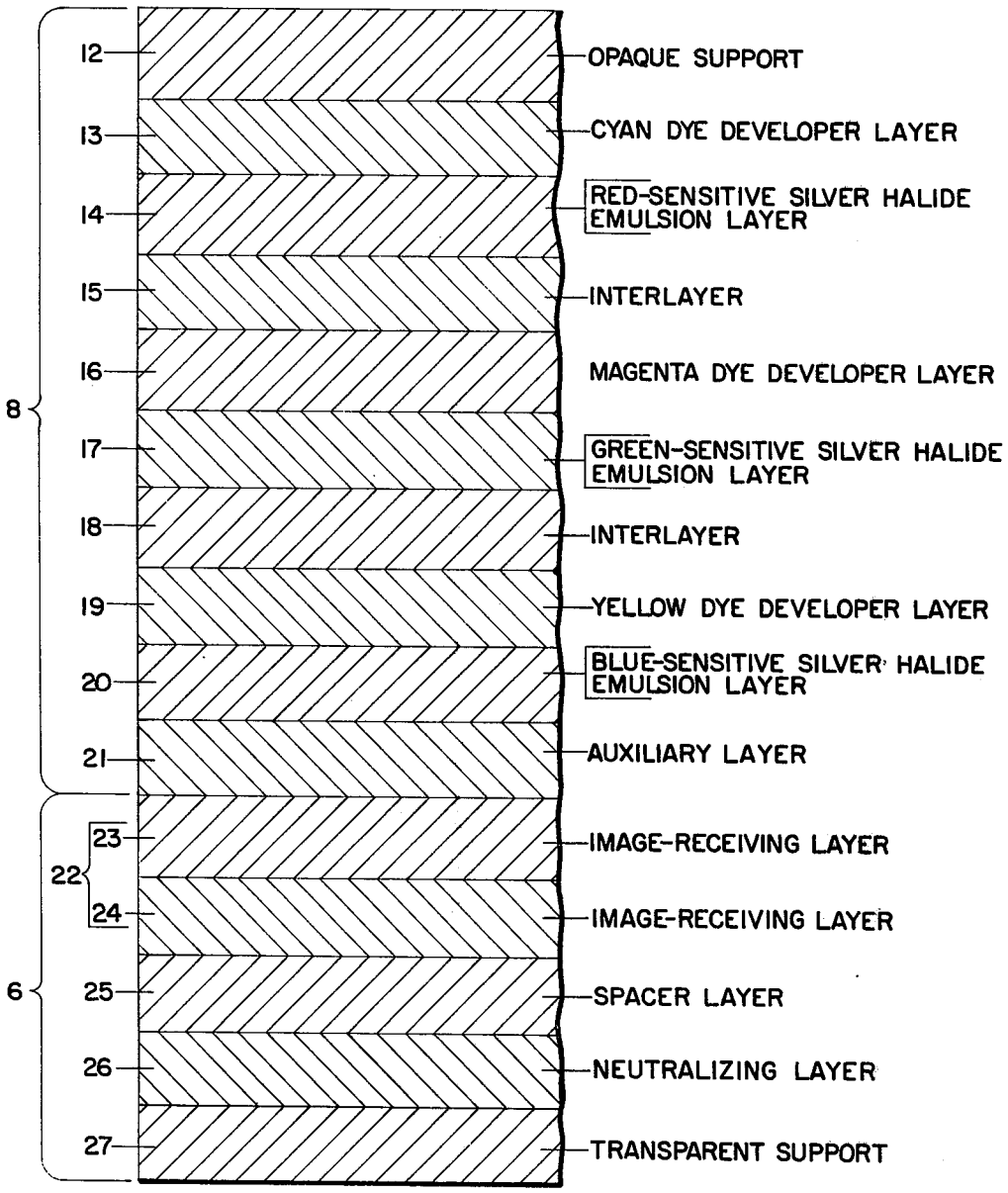

As mentioned, the distinctive feature of the diffusion transfer photographic products and processes of the present invention involves an image-receiving element including at least two layers one of which comprises a polymeric material having quaternary nitrogen groups which is isolated from the light-absorbing reagent by a layer of another polymeric material.

Broadly, the polymeric material suitable for inclusion as an image-receiving layer in the image-receiving elements comprise basic polymeric mordants having quaternary nitrogen groups. Accordingly, suitable polymeric materials include those described in detail in U.S. Pat. Nos. 3,758,445; 3,709,690, and 3,788,855, and these Patents are expressly incorporated here. Particularly suitable are those which conform to the following formula:

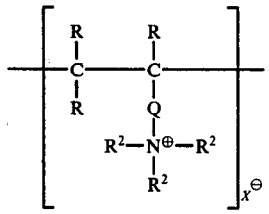

where each R can be the same or different substitutent which does not interfere with polymerization of the vinyl monomer involved and specifically can be hydrogen, aryl or lower alkoxy, alkanol or alkyl, e.g., having one to six carbons; Q is a covalent linking radical such as a divalent alkylene, arylene, aralkylene or arylenealkyl; where $R^2$ can be the same or different substituent preferably selected from the group consisting of alkyl or carbocyclic radicals such as aryl, aralkyl or cyclic alkyl but $R^2$ can be alkoxy, hydrogen, alkanol, etc., while $X^-$ represents an anion.

Especially preferred image-receiving sheets are those which comprise a layer of a polymeric mordant of the type described in detail in U.S. Pat. No. 3,770,439, to the following formula:

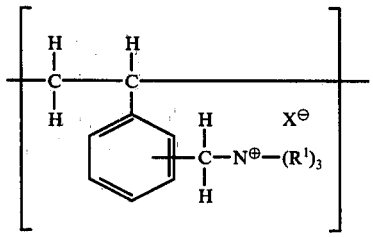

where $R^1$ is preferably alkyl but can be the same or different substituent chosen from the group consisting of hydrogen, lower alkoxy, and lower alkanol and $X^-$ is an anion. Compounds of the above formula where at least one R′ is carbocyclic are also suitable.

Other suitable image-receiving sheets comprising discrete layer of a polymer providing quaternary nitrogen groups are those wherein the layer includes polymeric materials of the type described in detail in U.S. Pat. No. 3,756,814. Such polymeric materials comprise a graft copolymer represented by the formula:

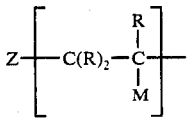

where Z represents a graftable organic backbone;

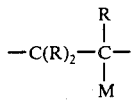

represents the residue of a graftable vinyl group and each R is the same or different substituent which will not hinder grafting of the residue ot the backbone and, in certain copolymers, disclosed, M is a moiety which provides quaternary nitrogen groups.

Other details relating to polymeric materials providing quaternary nitrogen groups may be found in U.S. Pat. Nos. 3,698,896 and 3,721,556.

As already mentioned, polymeric materials providing quaternary nitrogen groups have been employed in combination with other polymeric materials to provide image-receiving layers which are substantially transparent and water permeable and/or swellable but substantially water insoluble. Representative polymeric materials employed in combination with the polymeric material providing quaternary nitrogen groups include the polymers and copolymers of polyvinyl alcohol of polyvinyl alcohol, polyacrylamide, polyvinyl pyridine and polyhydroxy alkyl cellulose. Unlike such image-receiving sheets, however, the image-receiving sheets of the present invention comprise a discrete layer of a polymeric material providing quaternary nitrogen groups in combination with at least one other layer comprising any of the polymeric materials or mixtures thereof mentioned above. An especially preferred polymeric material for use in the "other" layer of the combination of layers comprising image-receiving sheets of the present invention comprises a blend or mixture of a polyacrylamide and a polyvinyl pyridine wherein the ratio of polyacrylamide to polyvinyl pyridine is about 2:1. Layers comprising the above-described blend of polymeric materials are particularly efficient presenting minimal interference with transfer of the dye image pattern to the image-receiving sheet. This minimal interference is perhaps due to the swellability characteristics of the blend and other polymers or blends thereof which can provide or be adjusted to provide similar swellability characteristics are especially suitable.

In the preferred embodiment, the especially preferred diffusion transfer photographic product and processes of the present invention are of the type described in the aforementioned U.S. Pat. Nos. 3,415,644 and 3,647,437. In such products and processes, the processing composition employed to develop the image pattern is of the type mentioned previously including a white pigment reflecting agent and at least one optical filter agent.

As was mentioned before, the novel film units contemplated by this invention include a photosensitive system, an image-receiving system and a reflection system as means for providing a reflecting layer between the photosensitive and image-receiving systems so that a transfer image formed in the image-receiving system may be viewed, without separation, as a reflection print.

Details relating to preferred embodiments of the present invention will be better appreciated by reference to FIG. 1 which illustrates a typical film unit of the type to which this invention is directed.

As shown in the drawing, such a film unit includes a photosensitive element designated as 8 which can comprise a layer 13 of cyan dye developer, red-sensitive silver halide emulsion layer 14, interlayer 15, a layer of magenta dye developer 16, green-sensitive silver halide emulsion layer 17 interlayer 18, yellow dye developer layer 19, blue-sensitive silver halide emulsion layer 20, auxiliary layer 21. The film unit additionally includes an integral image-receiving element generally designated as 6 which can comprise image-receiving portion 22 comprising two discrete layers 23 and 24, spacer layer 25, and a pH-reducing or neutralizing layer 26. Layers 12–21 comprise the photosensitive sheet and layers 23 and 27 comprise the image-receiving system or element. These layers are shown to be confined between a dimensionally stable layer or support member 12 which is preferably opaque so as to permit development in the light and dimensionally stable layer or support member 27 which is transparent to permit exposure of the photosensitive system and viewing of a color transfer image formed as a function of development in image-receiving sheet 22.

As examples of useful materials for supports 12 and 27, mention may be made of those having the aforementioned characteristics and which are polymers derived from ethylene glycol and terephthalic acid; vinyl chloride polymers; polyvinyl acetate; cellulsoe derivatives, etc. An especially preferred polymeric material is "Mylar". As heretofore noted layer 12 is of sufficient opacity to prevent fogging from occurring by light passing therethrough, and support 27 is transparent to permit photoexposure and for viewing of a transfer image formed in receiving stratum 22. Other suitable materials are well known to those skilled in the art.

The silver halide layers preferably comprise photosensitive silver halide, e.g., silver chloride, bromide or iodide or mixed silver halides such as silver iodobromide or chloroiodobromide dispersed in a suitable colloidal binder such as gelatin and such layers may typically be on the order of 0.6 to 6 microns in thickness. It will be appreciated that the silver halide layers may and in fact generally do contain other adjuncts, e.g., chemical sensitizers such as are disclosed in U.S. Pat. Nos. 1,575,944; 1,623,499; 2,410,689; 2,597,856; 2,597,915; 2,487,850; 2,518,698; 2,521,926; etc.; as well as other additives performing specific desired functions, e.g., coating aids, hardeners, viscosity-increasing agents, stabilizers, preservatives, ultraviolet absorbers and/or speed-increasing compounds. While the preferred binder for the silver halide is gelatin, others such as albumin, casein, zein, resins such as cellulose derivatives, polyacrylamides, vinyl polymers, etc., may replace the gelatin in whole or in part.

The film units of the present invention preferably include a phthalocyanine dye developer of the type described before. Other dye developers which can also be included are known to the art and especially metallized dye developers of the type described in such Patents as U.S. Pat. Nos. 3,563,739; 3,551,406 and 3,597,200. Preferably, the respective dye developers are dispersed in an aqueous alkaline permeable polymeric binder, e.g., gelatin as a layer from about 1 to 7 microns in thickness.

Interlayers 15, 18 and 21 may comprise an alkaline permeable polymeric material such as gelatin and may be on the order of from about 1 to 5 microns in thickness. As examples of other materials for forming these interlayers, mention may be made of those disclosed in U.S. Pat. Nos. 3,421,892, 3,575,700 and 3,615,422. These interlayers may also contain additional reagents performing specific functions and the various ingredients necessary for development may also be contained initially in such layers in lieu of being present initially in the processing composition, in which event the desired developing composition is obtained by contacting such layers with the solvent for forming the processing composition, which solvent may include the other necessary ingredients dissolved therein.

Layer 23 of image-receiving system 22 may be on the order of 0.1 to 0.2 mils in thickness. As mentioned an especially suitable, substantially water permeable or swellable but substantially water insoluble layer may be prepared by employing a 2:1 mixture of polyacrylamide and poly-4-vinyl pyridine. In the receiving sheets 22 of the present invention, layer 23 is positioned between the photosensitive system 8 and discrete layer 24.

Layer 24 may be on the order of 0.010 to 0.2 mil. in thickness. Typical materials suitably employed for this layer include dyeable polymeric materials providing quaternary nitrogen groups. Especially preferred polymeric materials are the polyvinylbenzyl trialkylammonium halides which can be employed alone or as mixtures with other polymeric materials such as the mixtures of U.S. Pat. No. 3,770,439. Such receiving layers may also contain specific reagents performing desired functions, e.g., a development restrainer, as disclosed, for example, in U.S. Pat. No. 3,265,498.

The spacer or timing layer may be on the order of 0.1 to 0.7 mil. thick. Materials useful for this purpose include polymers which exhibit inverse temperature-dependent permeability of alkali, e.g., as disclosed in U.S. Pat. No. 3,445,686. Materials previously employed for this layer include polyvinyl alcohol, cyanoethylated polyvinyl alcohol, hydroxypropyl polyvinyl alcohol, polyvinyl methyl ether, hydroxypropyl methyl cellulose, partial acetals of polyvinyl alcohol such as partial polyvinyl butyral and partial polyvinyl propional, polyvinyl amides such as polyacrylamide, etc.

The neutralizing layer may be on the order of 0.3 to 1.5 mil. in thickness. Materials useful in the preparation of this layer are known in the art and include the polymeric acids disclsoed in U.S. Pat. No. 3,362,819.

As is disclosed, for example, especially in U.S. Pat. No. 3,647,437, the film unit shown in the drawing may be developed by applying an aqueous alkaline processing composition including a reflection system which comprises a light absorbing reagent and a reflecting agent, e.g., titanium dioxide, between alyer 21 and layer 23 of image-receiving sheet 22 to form a color transfer image viewable through support 27, without separation, as a color reflection print.

In order to illustrate the advantages and benefits of the present invention by way of comparative data, diffusion transfer photographic products were prepared by coating a gelatin-subcoated, 4 mil., opaque polyethylene terephthalate film base with the following layers:

1. a layer of cyan dye developer dispersed in gelatin and coated at a coverage of about 50 mgs./ft.$^2$ of dye and about 28 mgs./ft.$^2$ of gelatin;

2. a red-sensitive gelatino silver iodobromide emulsion coated at a coverage of about 82 mgs./ft.$^2$ of silver and about 36 mgs./ft.$^2$ of gelatin;

3. a layer of a 60-30-4-6 copolymer of butylacrylate, diacetone acrylamide, styrene and methacrylic acid and polyacrylamide coated at a coverage of about 220 mgs./ft.$^2$ of the copolymer and about 7 mgs./ft.$^2$ of polyacrylamide;

4. a layer of magenta dye developer dispersed in gelatin and coated at a coverage of about 75 mgs./ft.$^2$ of dye and about 45 mgs./ft.$^2$ of gelatin;

5. a green-sensitive gelatino silver iodobromide emulsion coated at a coverage of about 80 mgs./ft.$^2$ of silver and about 35 mgs./ft.$^2$ of gelatin;

6. a layer containing the copolymer referred to above in layer 3 and polyacrylamide coated at a coverage of about 132 mgs./ft.$^2$ of copolymer and about 8 mgs./ft.$^2$ of polyacrylamide;

7. a layer of yellow dye developer dispersed in gelatin and coated at a coverage of about 70 mgs./ft.$^2$ of dye and about 30 mgs./ft.$^2$ of gelatin;

8. a blue-sensitive gelatino silver iodobromide emulsion layer including the auxiliary developer 4'-methylphenyl hydroquinone coated at a coverage of about 96 mgs./ft.$^2$ of silver, about 42 mgs./ft.$^2$ of gelatin and about 15 mgs./ft.$^2$ of auxiliary developer; and 9. a layer of gelatin coated at a coverage of about 30 mgs./ft.$^2$ of gelatin.

The three dye developers employed above were the following:

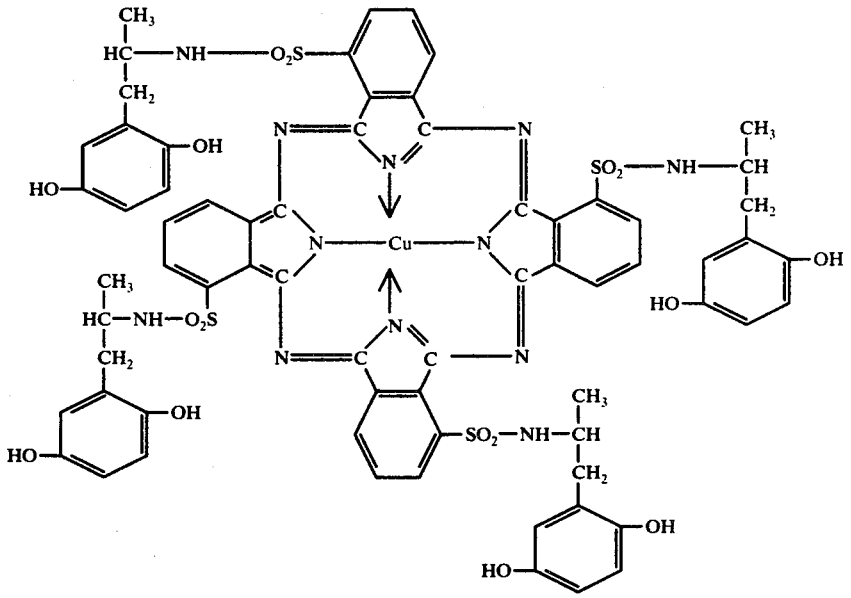

a cyan dye developer;

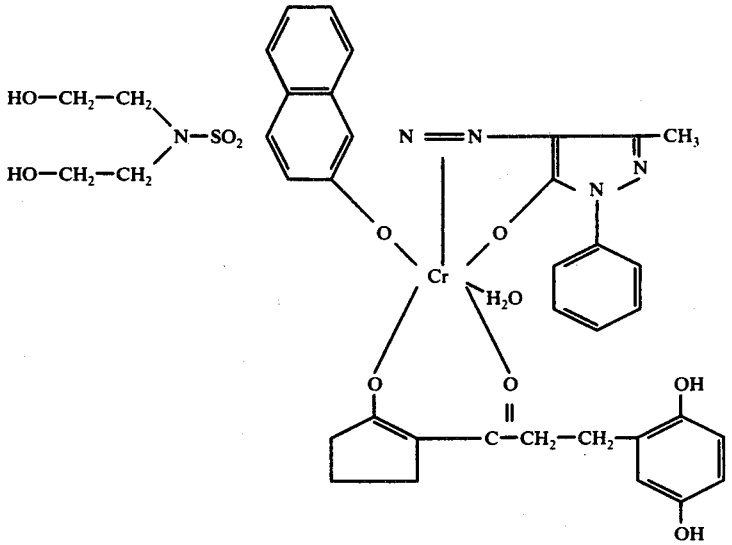

a magenta dye developer; and

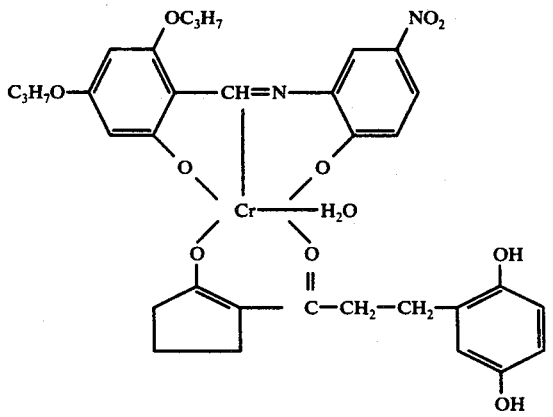

a yellow dye developer.

A transparent 4 mil. polyethylene terephthalate film base was coated, in succession, with the following illustrative layers of the image-receiving element:

1. a polymeric acid neutralizing layer containing a 7:3 mixture, by weight, of the partial butyl ester of a polyethylene/maleic anhydride copolymer and 88–90% hydrolyzed polyvinyl butyral at a coverage of about 2500 mgs./ft.$^2$;

2. a layer comprising about 93 parts by weight of a 60-30-4-6 copolymer of butylacrylate, diacetone acrylamide, styrene and methacrylic acid and about 7 parts of polyvinylalcohol coated at a coverage of about 500 mgs./ft.$^2$, to provide a polymeric spacer or timing layer;

3. an image-receiving system was provided which comprised a discrete layer of a polymeric material having quaternary nitrogen groups. The particular polymeric material employed in the image-receiving system of each image-receiving element as well as the coverage thereof will be described in more detail in the comparative Examples appearing hereinafter. However, in the "Control" for the Examples, the image-receiving layer was prepared from a 2:1 mixture of polyvinyl alcohol and poly-4-vinyl pyridine coated at a coverage of about 300 mgs./ft.$^2$;

4. A 2:1 mixture of polyacrylamide and poly-4-vinyl pyridine was then coated at a coverage of 300 mgs./ft.$^2$ to complete the image-receiving element. This mixture, however, was not applied to the image-receiving element of the control.

The negative and positive elements were then laminated together to provide an integral film unit.

A rupturable container comprising an outer layer of lead foil and an inner liner or layer of polyvinyl chloride retaining an aqueous alkaline processing solution was fixedly mounted on the leading edge of each of the laminates, by pressure-sensitive tapes, interconnecting the respective container and laminates so that, upon application of compressive pressure to the container to rupture the container's marginal seal, its contents may be distributed between auxilary layer (layer 21) of the negative component and layer 23 of the image-receiving system.

The processing composition employed in the rupturable container comprised the following ingredients:

| | | |
|---|---|---|
| Water | 100 | cc. |
| Potassium hydroxide | 10.5 | gms. |
| Hydroxyethyl cellulose (high viscosity) [commercially available from Hercules Powder Co., Wilmington, Delaware, under the trade name Natrasol 250] | 2.35 | gms. |
| 6-methyl uracil | 0.668 | gms. |
| N-phenethyl-α-picolinium bromide | 2.7 | gms. |
| Benzotriazole | 1.27 | gms. |
| Titanium dioxide | 95 | gms. |
| N-benxyl-α-picolinium bromide | 1.6 | gms. |
| 6-bromo-5-methyl-4-aza-benzinimidazole | 0.063 | gms. |
| | 1.37 | gms. |

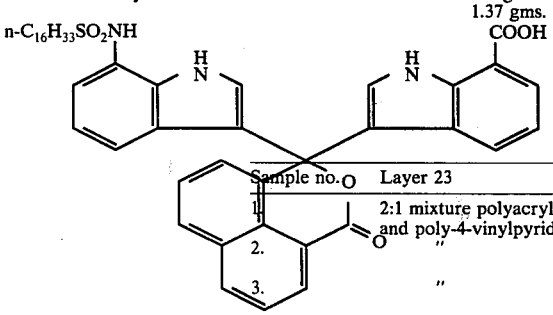

-continued

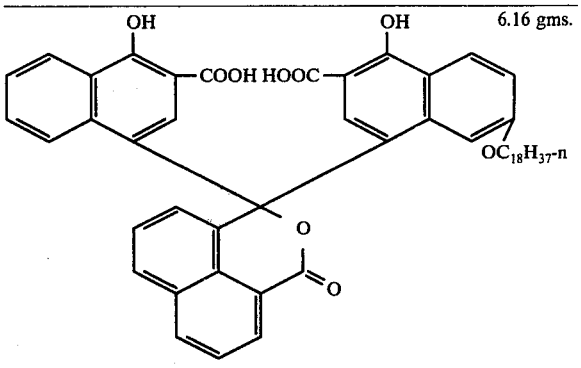

Film units of the foregoing description may be exposed in known manner to form a developable image and developed by applying compressive pressure to the rupturable container in order to distribute the aqueous alkaline process composition, thereby forming a multicolor transfer image which is viewable through the transparent polyethylene terephthalate film base as a positive reflection print. As was discussed before, this development may be effected in the presence of actinic light because the negative component is suitably protected from fogging.

EXAMPLES

Diffusion transfer film units were prepared in the manner described above. With the exception of Samples 5 and 6, image-receiving systems of each of these film units comprised a polymeric material providing quaternary nitrogen groups overcoated with a polymeric layer. The particular polymeric material providing quaternary nitrogen groups as well as the coverage thereof in each film unit and the composition and coverage of the polymeric layer if any in each film unit are set forth below:

| Sample no. | Layer 23 | Coverage | Layer 24 | Coverage |
|---|---|---|---|---|
| 1. | 2:1 mixture polyacrylamide and poly-4-vinylpyridine | 300 mgs/ft$^2$ | polyvinylbenzyl trimethyl ammonium chloride[a] | 75 mgs/ft$^2$ |
| 2. | " | " | polyvinylbenzyl trimethyl ammonium chloride[a] | 50 mgs/ft$^2$ |
| 3. | " | " | polyvinylbenzyl trimethyl ammonium chloride[a] | 25 mgs/ft$^2$ |
| 4. | Image receiving system 22 a 1:1:0.5 mixture of polyvinyl alcohol, poly-4-vinylpyridine and polyvinylbenzyl trimethyl ammonium CHLORIDE | 300 mgs/ft$^2$[b] | none | none |
| 5. (control) | 2:1 mixture of polyvinyl alcohol and poly-4-vinylpyridine | 300 mgs/ft$^2$ | none | none |

[a]a mixture, about 1:1 of meta and para polyvinylbenzyl trimethyl ammonium chlorides sold by Dow Chemical Company under the trade name "E. C. R. 34"

[b]coverage corresponds to a coverage of 60 mgs/ft$^2$ in terms of polyvinylbenzyl trimethyl ammonium chloride Diffusion transfer film units of the type described above were exposed and processed at a temperature of 25° C. and measurements relating to both the density of the image dye and the density of the light-absorbing reagent, e.g., indicator dyes were made at various increments of time during processing of Samples 1–6.

Figure 2:
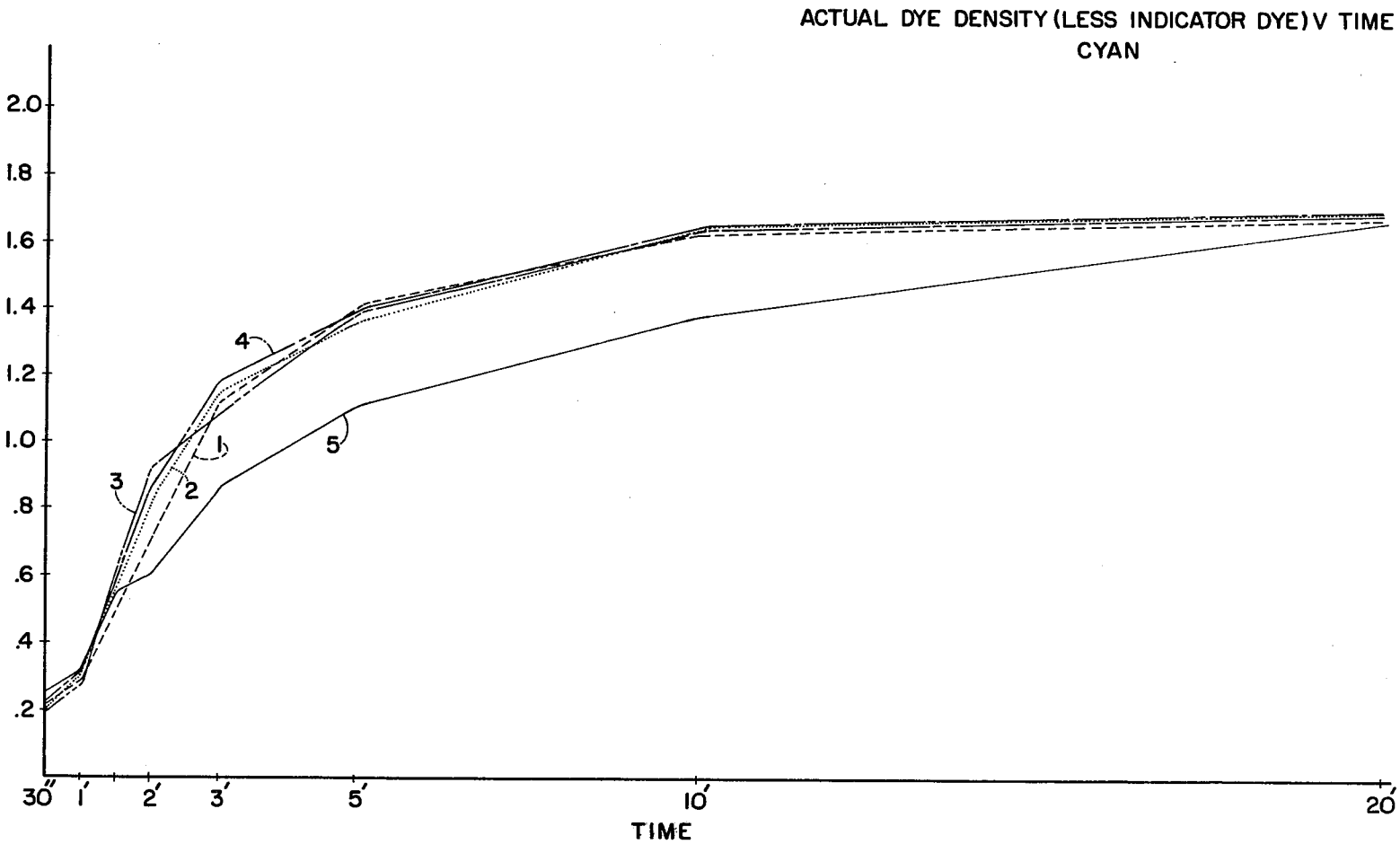
Figure 3:
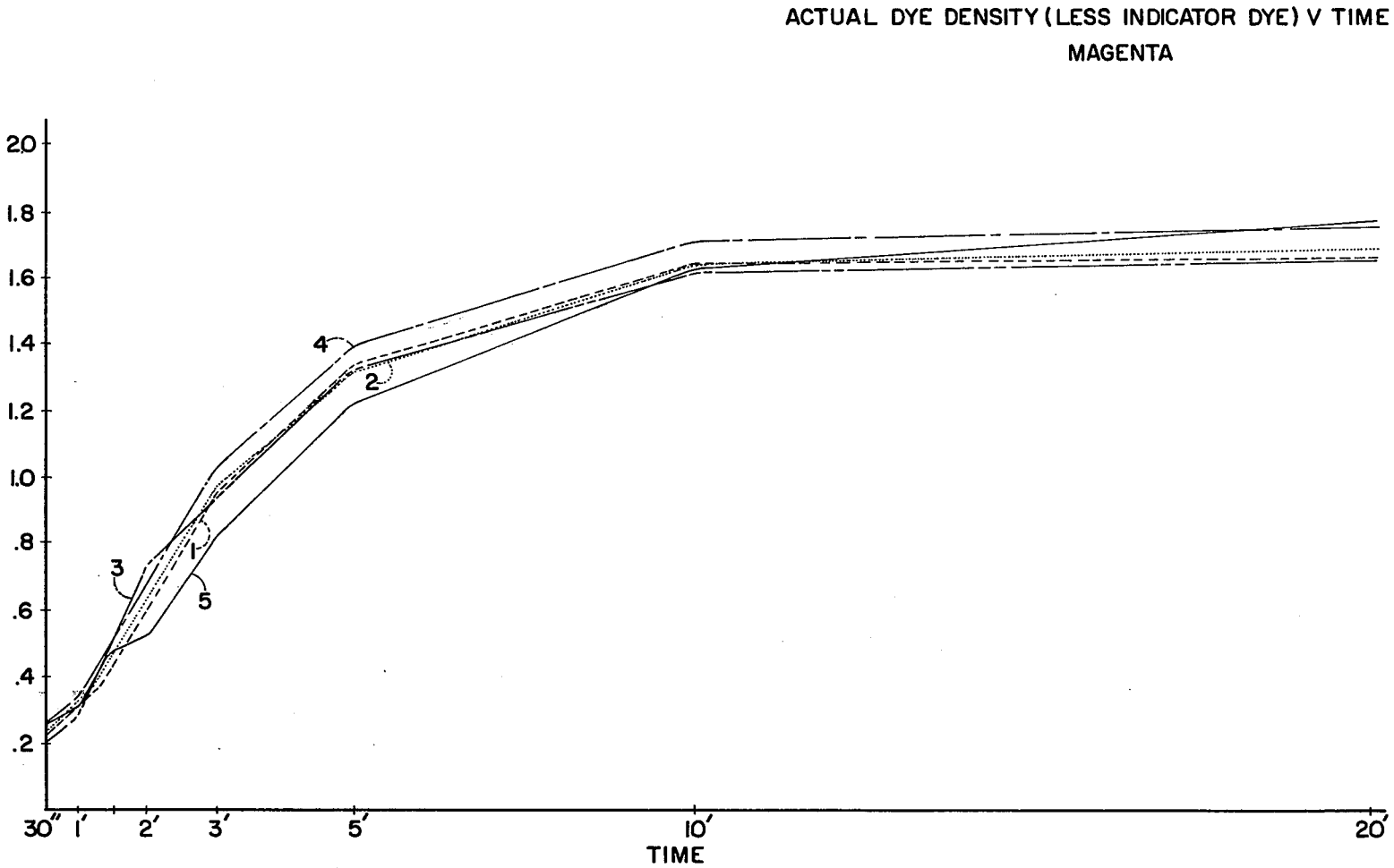
Figure 4:
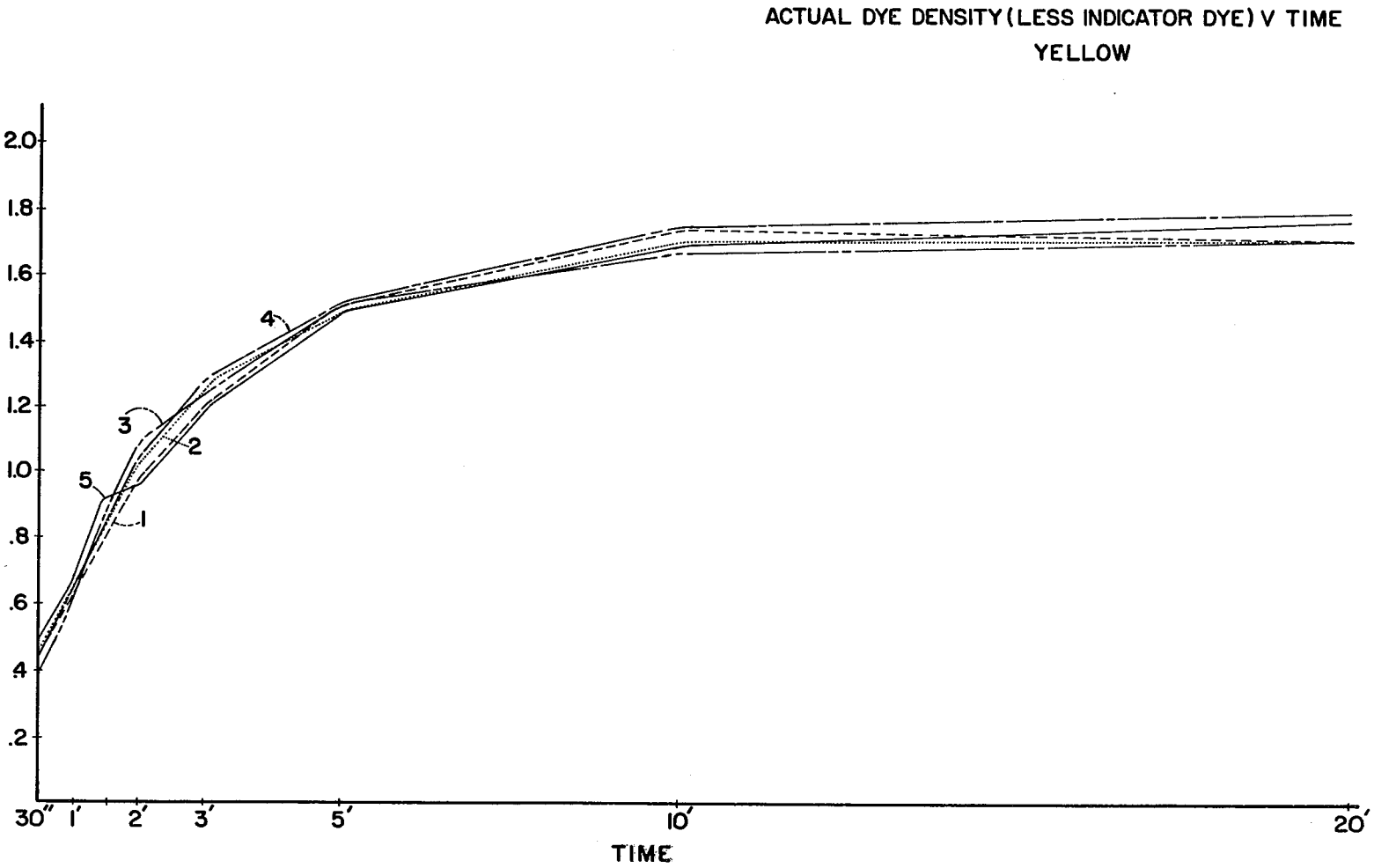

FIGS. 2, 3 and 4 graphically represent a direct comparison of measurements of the actual image dye density at various times during processing thereby providing a measure of the relative dye transfer efficiency for the image-receiving layers of each unit. As can be seen from the Figures and especially FIG. 2, image-receiving systems comprising a discrete layer of a polymeric material having quaternary nitrogen groups present a particularly desirable balance of performance characteristics especially with respect to the transfer rate of cyan dye developer. For example, FIG. 2 evidences a markedly improved transfer rate of cyan dye in samples 1, 2, 3, 4 as opposed to the somewhat slower transfer rate obtained in the control (Sample 5). Also, this improved transfer rate of cyan dye is obtained without imparing or otherwise adversely affecting the transfer rate of the magenta dye developer as evidenced by FIG. 3 or the yellow dye developer as evidenced by FIG. 4.

Figure 5:
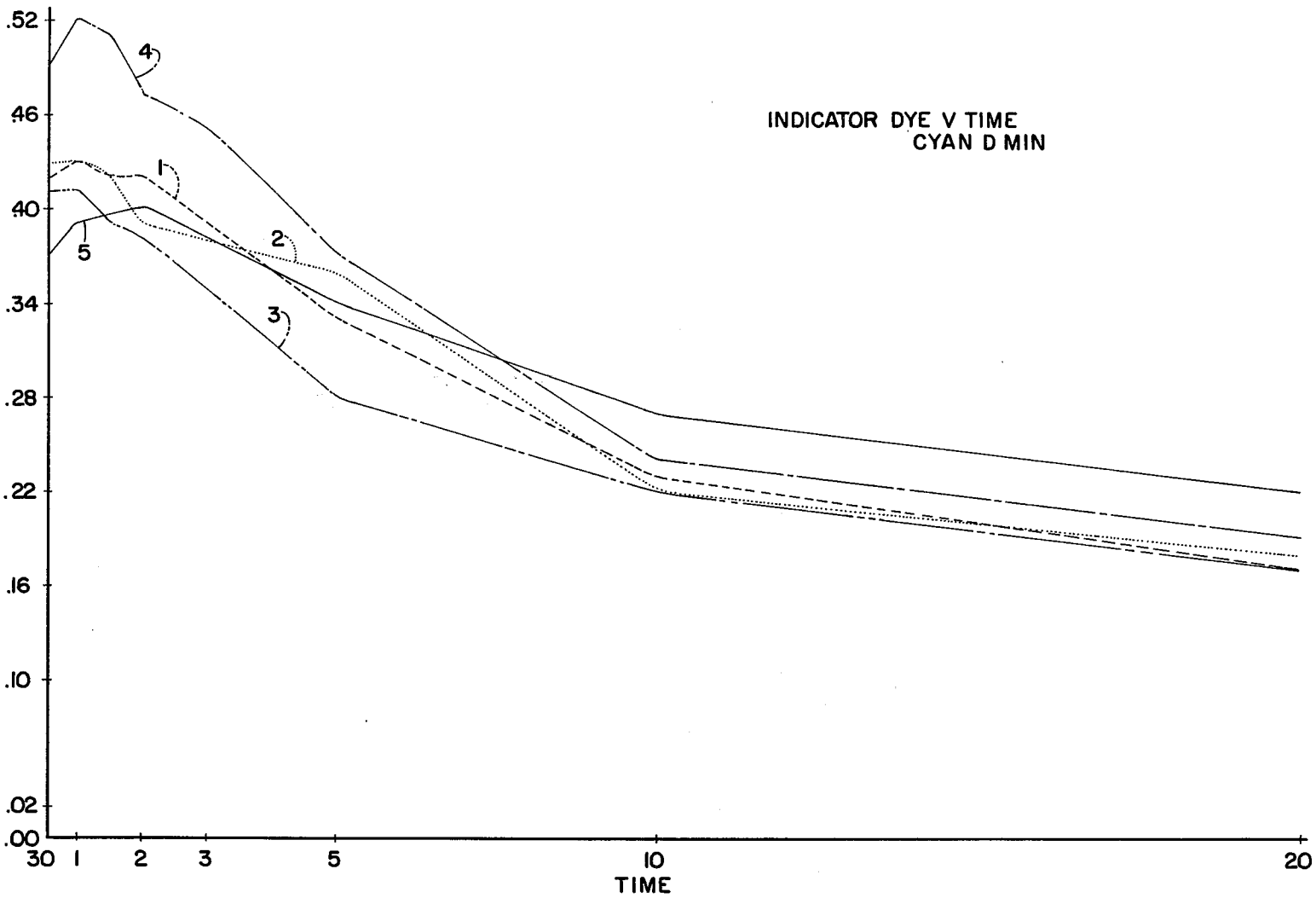
Figure 6:
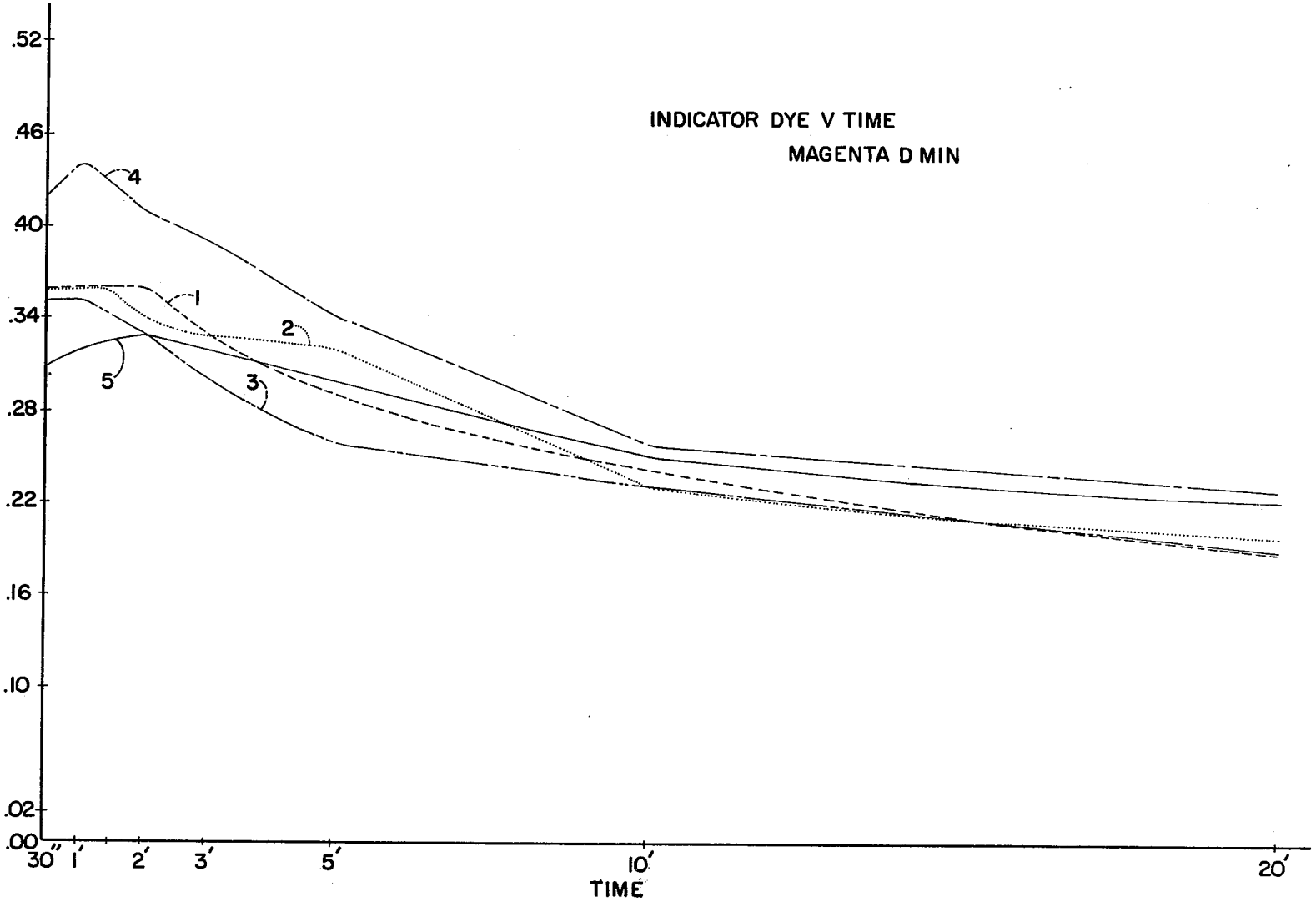
Figure 7:
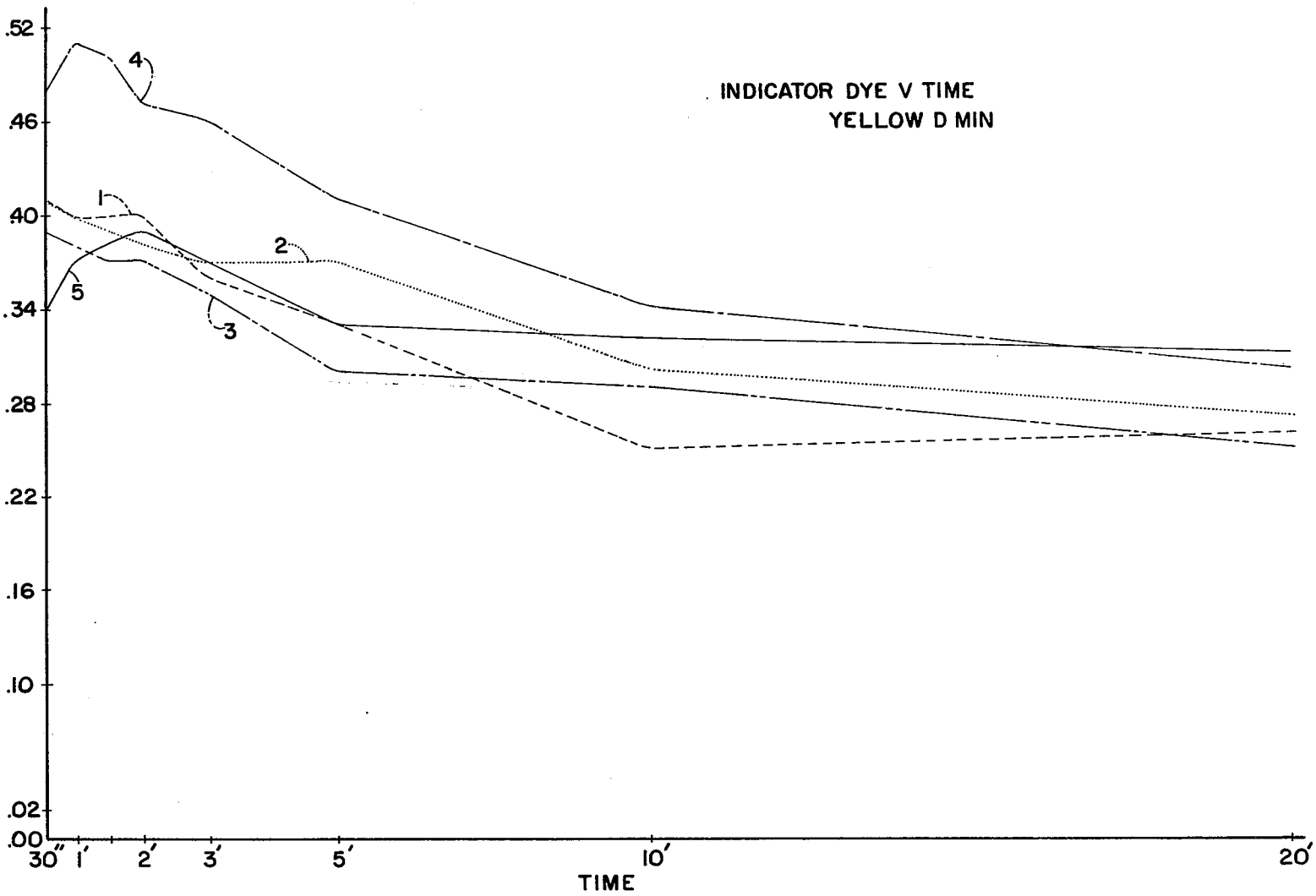

FIGS. 5, 6 and 7 graphically represent a direct comparison of measurements reflecting the diminishing density of the light-absorbing reagents or indicator dyes at various times during processing, measured as added density in the $D_{min}$ regions of the cyan, magenta and yellow color columns. It should be pointed out that the curve of the "control" (Sample 5) correspondes very closely to the curve obtained with present commercial film units used in advanced photographic cameras sold by Polaroid Corporation under the trade name "SX-70". However, as mentioned before, image-receiving sheets comprising a polymeric material providing quaternary nitrogen groups have affected the discharge of the color of these reagents in an undesirable fashion. This interference is best evidenced by a comparison of the curve of sample 4 with the curve of sample 5. Sample 4 involves an image-receiving sheet comprising a vinylbenzyl trimethyl ammonium chloride but this polymeric material is not isolated from other materials as a discrete layer. Instead, the image-receiving sheet of sample 4 comprises a mixture of polyvinyl-benzyl trimethyl ammonium chloride with polyacrylamide and poly-4-vinylpyridine. An examination of FIGS. 5, 6, and 7 reveals that the isolation of the polyvinylbenxyl trimethyl ammonium chloride from the other polymeric materials and the use of the quaternary nitrogen providing polymer as a discrete layer minimizes this interference and the curves for samples 1, 2, and 3 correspond very closely to the curve of sample 5 and particularly in the case of sample 3, marked improvements are shown. Also note that the thickness of the discrete layer comprising the polymeric material providing quaternary nitrogens of samples 1, 2, and 3 appears to have some effect on the performance characteristics of the indicator dye thereby providing a degree of control for adjusting such characteristics to a preselected degree. In the preferred image-receiving sheets of the present invention, the thickness of the discrete layer of the polymeric material providing the quaternary nitrogen is less than about 100 mgs./ft.$^2$.

As can be seen from the foregoing description, the invention presents novel, useful and improved diffusion transfer photographic products and the essence of the invention resides in a distinctive integration and arrangement of a layer comprising a polymer containing quaternary nitrogen groups in diffusion transfer products employing pH-sensitive optical filter agents as light-absorbing reagents. Accordingly, various modifications of incidental details involved in the foregoing detailed description offered for the purposes of illustrating preferred embodiments may be employed without departing from the scope of the invention defined in the appended claims.

What is claimed is:

1. An image receiving element for a diffusion transfer film unit which comprises a transparent support carrying a polymeric layer comprising a polymeric mordant having quaternary nitrogen groups said polymeric layer overcoated with a layer comprising a mixture of a polyacrylamide and a polyvinylpyridine and said polymeric mordant is a polymer selected from Formula A or Formula B below:

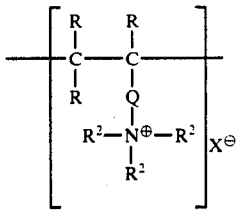

FORMULA A

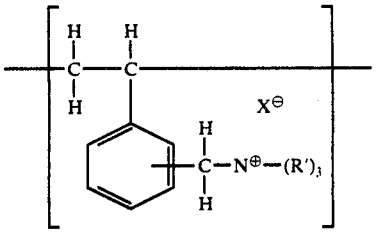

FORMULA B where each R can be the same or different substituent which does not interfere with polymerization of the vinyl group; Q is a covalent linking radical selected from the group consisting of alkylene, arylene, aralkylene or arylenealkyl; $R^2$ can be the same or different substituent chosen from the group consisting of alkyl or carbocyclic; each R′ can be the same or different substituent chosen from the group consisting of hydrogen, hydroxyl, alkyl, alkoxy, alkanol or at least one R′ can be carbocyclic and $X^-$ represents an anion.

2. An image receiving element of claim 1 wherein the polymeric mordant having quaternary nitrogen groups is a polymer of said formula:

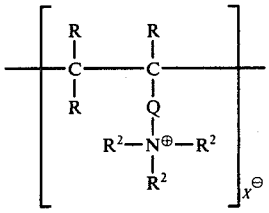

where each R can be the same or different substituent which does not interfere with polymerization of the vinyl group; Q is a covalent linking radical selected from the group consisting of alkylene, arylene, aralkylene or arylenealkyl; $R^2$ can be the same or different substituent chosen from the group consisting of alkyl or carbocyclic; and $X^-$ represents an anion.

3. An image receiving element of claim 1 wherein the polymeric mordant having quaternary nitrogen groups is a polymer of said formula:

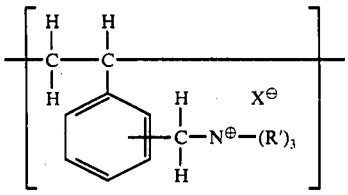

where each R′ can be the same or different substituent chosen from the group consisting of hydrogen, hydroxyl, alkyl, alkoxy, alkanol or at least one R′ can be carbocyclic and where $X^-$ represents an anion.

4. An image receiving element of claim 3 wherein said layer comprising said mixture comprises a blend of polyacrylamide and polyvinyl pyridine and the ratio of polyacrylamide to polyvinyl pyridine is about 2:1.

5. An image receiving element of claim 4 wherein said polymeric material having quaternary nitrogen groups is a vinyl-benzyltrialkylammonium halide.

6. In a composite photographic diffusion transfer film unit which comprises a plurality of elements maintained in substantially fixed relationship during and after photoexposure and which includes in order, a transparent sheet having a photoexposure area through which a corresponding image area of a photosensitive layer is exposed; an image receiving sheet adapted to receive and exhibit for viewing a transfer dye image; at least one photosensitive silver halide layer associated with a diffusion transfer process dye image-providing material; a first opaque sheet and means for distributing an opaque diffusion transfer processing composition between predetermined elements of the unit;

said means for distributing the opaque processing composition comprising a rupturable container retaining an aqueous alkaline processing composition which can initiate development of the exposed photosensitive layer and having dispersed therein, opaque layer providing materials which include an inorganic reflecting pigment and at least one pH sensitive optical filter agent in a concentration effective to provide on distribution a layer exhibiting an optical transmission density effective to protect a photoexposed silver halide layer from actinic radiation incident on said opaque layer; the container being positioned transverse a leading edge of the film unit so that after photoexposure of the film unit, the container is adapted to be ruptured by pressure applying members to distribute the contents of the container between the image receiving sheet and the exposed photosensitive layer; and, said image receiving sheet comprises a neutralizing layer for discharging the color of said optical filter agent after substantial diffusion of dye image providing material to said image receiving sheet;

the improvement wherein said image receiving sheet comprises a layer which comprises a polymeric mordant having quaternary nitrogen groups and at least one other layer comprising a mixture of a polyacrylamide and a polyvinylpyridine positioned between said layer comprising the polymeric mordant and the photosensitive layer, and said polymeric mordant is a polymer selected from Formula A or Formula B below:

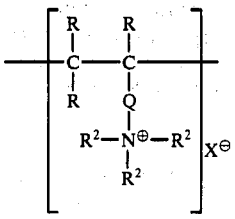

FORMULA A

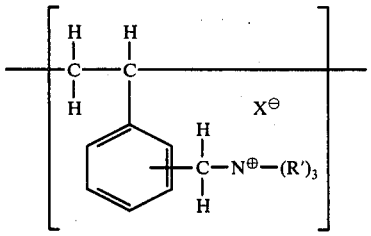

FORMULA B where each R can be the same or different substituent which does not interfere with polymerization of the vinyl group; Q is a covalent linking radical selected from the group consisting of alkylene, arylene, aralkylene or arylenealkyl; $R^2$ can be the same or different substituent chosen from the group consisting of alkyl or carbocyclic; each R′ can be the same or different substituent chosen from the group consisting of hydrogen, hydroxyl, alkyl, alkoxy, alkanol or at least one R′ can be carbocyclic and $X^-$ represents an anion.

7. An image receiving element of claim 6 wherein the polymeric mordant having quaternary nitrogen groups is a polymer of said formula:

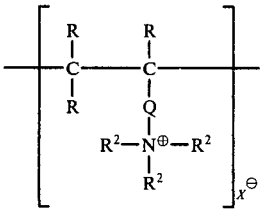

where each R can be the same or different substituent which does not interfere with polymerization of the vinyl group; Q is a covalent linking radical selected from the group consisting of alkylene, arylene, aralkylene or arylenealkyl; $R^2$ can be the same or different substituent chosen from the group consisting of alkyl or carbocyclic; and $X^-$ represents an anion.

8. A film unit of claim 6 wherein the polymeric mordant having quaternary nitrogen groups is a polymer of said formula:

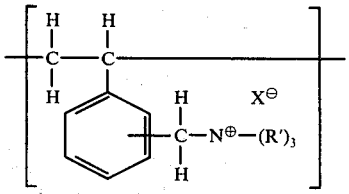

wherein each R′ can be the same or different substituent chosen from the groups consisting of hydrogen, hydroxyl, alkyl, alkoxy, alkanol or at least one R′ can be carbocyclic and $X^-$ represents an anion.

9. A film unit of claim 8 wherein said layer comprising said mixture comprises a blend of polyacrylamide and polyvinyl pyridine and the ratio of polyacrylamide to polyvinyl pyridine is about 2:1.

10. A film unit of claim 9 wherein said polymeric material having quaternary nitrogen groups is a vinylbenzyltrialkylammonium halide.

11. In a photographic film unit comprising a composite structure having in order, a layer opaque to incident actinic radiation; a photosensitive silver halide layer having associated therewith image-forming material comprising a dye developer which is processing composition soluble and diffusible as a function of the point-to-point degree of silver halide layer exposure to incident actinic radiation; a receiving sheet adapted to receive solubilized image-forming material diffusing thereto; means for distributing between the silver halide layer and the receiving sheet, and aqueous alkaline processing composition which includes an inorganic reflecting pigment dispersion and at least one organic optical filter agent at a pH about the pKa of the optical filter agent in a concentration effective to provide a layer exhibiting optical transmission density $> \sim 6.0$ density units with respect to incident radiation actinic to the photosensitive silver halide layer and optical reflection density $< \sim 1.0$ density units with respect to incident visible radiation, and said receiving sheet includes a neutralizing layer for reducing the pH of the film unit to a pH below the pKa of the optical filter agent;

the improvement wherein said receiving sheet includes a layer which comprises a polymeric mordant having quaternary nitrogen groups and at least one other layer comprising a mixture of a polyacrylamide and a polyvinylpyridine positioned between said layer comprising the polymeric mordant and the photosensitive layer and said polymeric mordant is a polymer selected from Formula A or Formula B below:

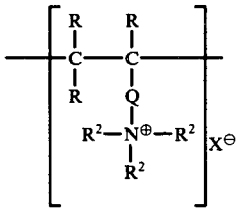

FORMULA A

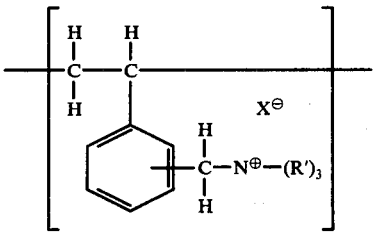

FORMULA B where each R can be the same or different substituent which does not interfere with polymerization of the vinyl group; Q is a covalent linking radical selected from the group consisting of alkylene, arylene, aralkylene or arylenealkyl; $R^2$ can be the same or different substituent chosen from the group consisting of alkyl or carbocyclic; each R′ can be the same or different substituent chosen from the group consisting of hydrogen, hydroxyl, alkyl, alkoxy, alkanol or at least one R′ can be carbocyclic and $X^-$ represents an anion.

12. A film unit of claim 11 wherein the polymeric mordant having quaternary nitrogen groups is a polymer of said formula:

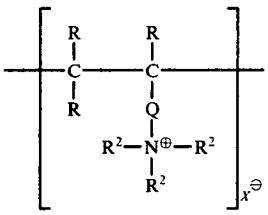

where each R can be the same or different substituent which will not interfere with polymerization of the vinyl group; Q is a covalent linking radical selected from the group consisting of alkylene, arylene, aralkylene or arylenealkyl; $R^2$ is the same or different substituent chosen from the group consisting of alkyl or carbocyclic and $X^-$ represents an anion.

13. A film unit of claim 11 wherein the polymeric mordant having quaternary nitrogen groups is a polymer of said formula:

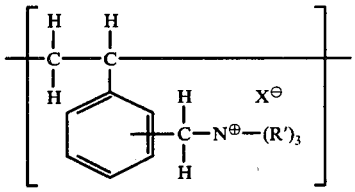

where each R′ can be the same or different substituent chosen from the groups consisting of hydrogen, hydroxyl, alkyl, alkoxy, alkanol or at least one R′ can be carbocyclic and $X^-$ represents an anion.

14. A film unit of claim 13 wherein said polymeric material comprises a blend of polyacrylamide and poly-4-vinyl pyridine and the ratio of polyacrylamide to poly-4-vinyl pyridine is about 2:1.

15. A film unit of claim 14 wherein said polymeric mordant having quaternary nitrogen groups is a polyvinyl-benzyltrialkylammonium halide.

16. A photographic film unit adapted to be processed by passing the unit between a pair of juxtaposed pressure-applying members and which comprises, in combination:

a photosensitive element including a composite structure containing, in order, a dimensionally stable opaque layer; at least two selectively sensitized silver halide emulsion layers possessing predominant spectral sensitivity to separate regions of the visible electromagnetic spectrum and a dye which is a silver halide developing agent and is soluble and diffusible, in alkaline processing composition, at a first pH associated with each of the silver halide emulsion layers and possessing a spectral absorption range subsequent to processing substantially complementary to the predominant sensitivity range of its associated emulsion layer; an alkaline solution permeable polymer layer comprising a mixture of polyacrylamide and a polyvinylpyridine; an alkali solution permeable polymeric layer comprising a polymeric mordant having quaternary nitrogen groups; a polymer layer possessing acid capacity effective to reduce alkaline processing composition possessing the first pH to a second pH at which the dyes are substantially nondiffusible; a dimensionally stable transparent layer; and means securing the layers in substantially fixed relationship;

a rupturable container retaining an alkaline processing composition possessing the first pH and retaining substantially uniformly disposed therein titanium dioxide and an organic optical filter agent substantially non-diffusible from the processing composition and possessing a pKa below the first pH and above the second pH wherein the filter agent exhibits spectral absorption substantially complementary to the predominant sensitivity range of the selectively sensitized silver halide emulsion layers at the first pH and the titanium dioxide and filter agent are present in quantity sufficient, upon distribution of the alkaline processing composition possessing the first pH as a layer intermediate the dyeable polymeric sheet and next adjacent selectively sensitized silver halide emulsion layer, to provide to the layer an optical transmission density $> \sim 6.0$ density units with respect to incident radiation actinic to the silver halide emulsion layers and an optical reflection $< \sim 1.0$ density units with respect to incident visible radiation, and said rupturable container is positioned and extends transverse an edge of the photosensitive element to effect unidirectional discharge of the container's alkaline processing composition intermediate the polymeric layer comprising said mixture of polyacrylamide and a polyvinylpyridine and the selectively sensitized silver halide emulsion layer next adjacent; said polymeric mordant of said alkali solution permeable polymeric layer being a polymer selected from Formula A or Formula B below:

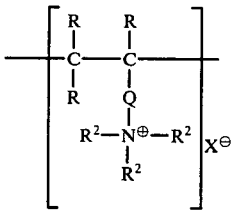

FORMULA A

-continued

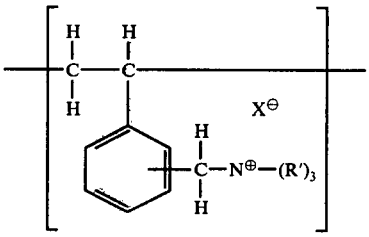

FORMULA B where each R can be the same or different substituent which does not interfere with polymerization of the vinyl group; Q is a covalent linking radical selected from the group consisting of alkylene, arylene, aralkylene or arylenealkyl; $R^2$ can be the same or different substituent chosen from the group consisting of alkyl or carbocyclic; each R′ can be the same or different substituent chosen from the group consisting of hydrogen, hydroxyl, alkyl, alkoxy, alkanol or at least one R′ can be carbocyclic and $X^-$ represents an anion.

17. A film unit of claim 16 wherein the polymeric mordant having quaternary nitrogen groups is a polymer of said formula:

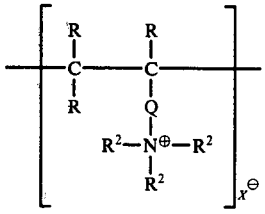

where each R can be the same or different substituent which will not interfere with polymerization of the vinyl group; Q is a covalent linking radical selected from the group consisting of alkylene, arylene, aralkylene or arylenealkyl; $R^2$ is the same or different substituent from the group consisting of alkyl or carbocyclic and $X^-$ represents an anion.

18. A film unit of claim 16 wherein the polymeric mordant having quaternary nitrogen groups is a polymer of said formula:

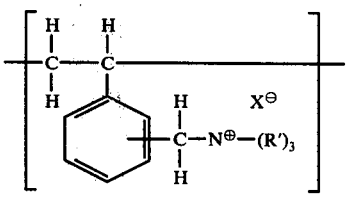

where each R′ can be the same or different substituent selected from the group consisting of hydrogen, hydroxyl, alkyl, alkoxy, alkanol or at least one R′ can be carbocyclic and $X^-$ represents an anion.

19. A film unit of claim 18 wherein said layer comprising said mixture comprises a blend of polyacrylamide and poly-4-vinyl pyridine and the ratio of polyacrylamide to poly-4-vinyl pyridine is about 2:1.

20. A film unit of claim 19 wherein said polymeric mordant having quaternary nitrogen groups is a polyvinylbenzyltrialkylammonium halide.

* * * * *